United States Patent [19]

Stafford

[11] Patent Number: 4,586,867

[45] Date of Patent: May 6, 1986

[54] CONNECTION DEVICES

[75] Inventor: Raymond Stafford, Wigan, Great Britain

[73] Assignee: Dobson Park Industries Plc, Nottingham, Great Britain

[21] Appl. No.: 565,419

[22] Filed: Dec. 27, 1983

[30] Foreign Application Priority Data

Dec. 24, 1982 [GB] United Kingdom ..... 8236781

[51] Int. Cl.[4] ..... B25G 3/18; B66C 23/00

[52] U.S. Cl. ..... 414/723; 403/322

[58] Field of Search ..... 403/322; 414/723

[56] References Cited

U.S. PATENT DOCUMENTS

| | | | |
|---|---|---|---|
| 3,204,793 | 9/1965 | Lane | 414/723 X |
| 4,068,959 | 1/1978 | Pemberton | 403/322 X |
| 4,253,793 | 3/1981 | Brami | 414/723 |
| 4,436,477 | 3/1984 | Lewertz et al. | 414/723 |

FOREIGN PATENT DOCUMENTS

| | | | |
|---|---|---|---|
| 0052987 | 11/1981 | European Pat. Off. . | |
| 0058058 | 8/1982 | European Pat. Off. . | |
| 0031659 | 3/1980 | Japan | 414/723 |
| 1053225 | 12/1966 | United Kingdom . | |
| 1089885 | 11/1967 | United Kingdom . | |
| 1360192 | 7/1974 | United Kingdom . | |
| 1472685 | 5/1977 | United Kingdom . | |
| 1492504 | 11/1977 | United Kingdom . | |
| 2053142 | 2/1981 | United Kingdom . | |

*Primary Examiner*—William E. Wayner

*Attorney, Agent, or Firm*—Murray and Whisenhunt

[57] ABSTRACT

A releasable connection device for coupling a bucket 9 to a vehicle comprises a support 2 attached to the lifting vehicle, the support comprising two arms 4, 6 and a channeled member 8 connected between the two arms. Two plates 14, 16 are attached to the bucket 9 and have a bar 18 connected between them. In use, the bar 18 fits into the channelled member 8 and the bucket 9 and support 2 are secured by two hydraulically operated locking bolts 22 attached to the support 2, which pass through holes 20 in plates 14 and 16. When connected, the bucket and support may be manoeuvred by means of hydraulic rams attached to the support.

11 Claims, 3 Drawing Figures

CONNECTION DEVICES

BACKGROUND TO THE INVENTION

The invention relates to connection devices.

The invention provides a releasable connection device for use in coupling an accessory, for example a bucket, to a support, for example a lifting vehicle, the releasable connection device comprising:

(a) a first mounting member;

(b) a second mounting member which co-operates with the said first mounting member;

(c) means for attaching one said mounting member to the said accessory;

(d) means for attaching the other said mounting member to the said support;

(e) an elongate channel which forms part of the said first mounting member;

(f) an elongate member which forms part of the said second mounting member and which, when the device is in use, is received in the said elongate channel;

(g) securing means operable to retain the said elongate member in the said elongate channel, and being releasable to enable the said elongate member to be disengaged from the said elongate channel.

The term "accessory" is intended to include not only buckets, but also other items such as bulldozer attachments, forklift devices, personnel carrier platforms, and tools.

Preferably the channel and the elongate member are constructed for attachment in such a manner that they will extend substantially horizontally when in use at the time of coupling.

The channel may face upwardly in use, the elongate member being engaged therein by moving the channel upwardly relatively to the elongate member, which will normally be stationary.

Preferably there are means associated with the elongate member to locate the said channel in a position suitable for coupling, prior to upward movement of the channel.

The elongate member preferably comprises a bar-like member.

There may be location means at each end of the bar.

The channel preferably forms part of a mounting frame.

The channel may be adapted to be attached to a vehicle having lifting and/or manipulative means.

The channel may be positioned at the top of the frame.

The channel may be perforated, for example so that any dirt entering the channel can pass out of the channel through the perforations.

The perforations may have any shape.

Preferably the channel is defined by a length of channel section. The channel section may for example be of V, half-round or rectangular cross-section.

The securing means are preferably positioned at a separate location to the co-operating first and second members.

The securing means may comprise at least one bolt which can engage through a correspondingly shaped hole or engage behind an appropriately shaped projection.

The or each bolt may be substantially horizontal in use.

Preferably two bolts are provided, the bolts moving in opposite directions.

The or each bolt may be movable by hydraulic means and may be spring assisted into engagement resulting in a 'fail safe' position.

The securing means may comprise latching means.

The securing means may for example comprise a slotted bar and lug arrangement.

A single hydraulic jack may for example be used to move the slotted bar between a disengagement position in which the lugs can pass through the slots and an engaged position in which non-slotted parts of the bar engage behind the lugs.

Preferably the securing means are operable remotely from the device, for example by a driver in the cab of a vehicle.

At least part of the support may abut the accessory when the support and accessory are coupled together.

The invention includes a releasable connection device as described above in combination with a support in the form of a vehicle.

The invention includes such a device in combination with an accessory in the form of a bucket.

Other preferred features and advantages of the invention will become apparent from the following description of an embodiment of the invention.

DESCRIPTION OF AN EMBODIMENT OF THE INVENTION

Figure 1:
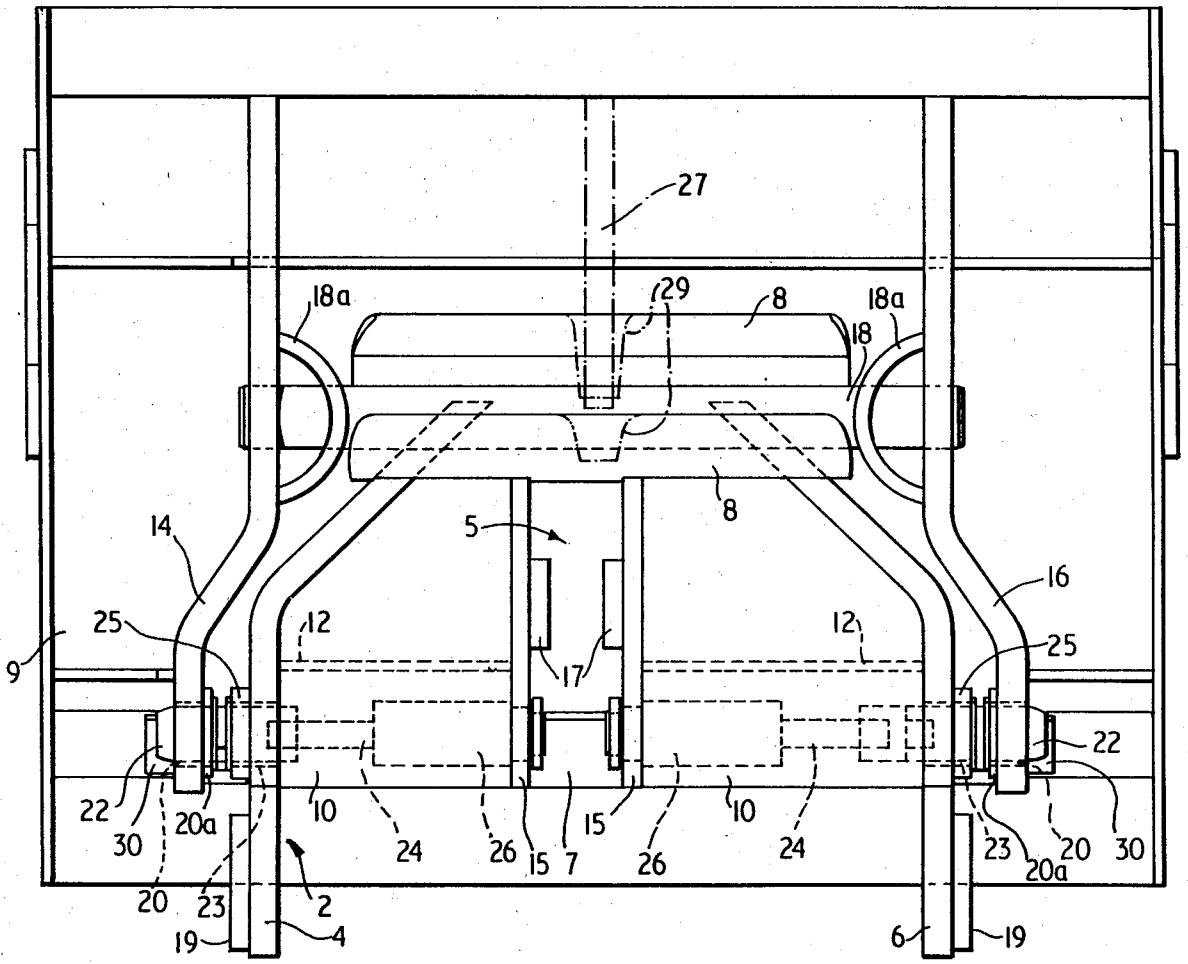
FIG. 1 is a rear view of an assembled loading bucket and lifting frame according to the invention.

A first mounting member comprises a lifting frame 2 which in turn comprises two frame members 4, 6 between which are welded an upper channel member 8 and a lower plate-like connecting member 7. The members 4, 6 are welded to the upper channel member 8 at points spaced from the ends of the channel, to reduce bending.

Welded between the members 7 and 8 are a pair of upwardly extending plate members 15, spaced apart to define an aperture 5. Welded between each of the members 4, 6 and the facing plate 15 is a transversely extending plate 10, and two support webs 12, 12. The channel member 8 is open upwardly and the channel bottom has a semi-circular shape. The upper channel sides are flared outwardly and the inner channel edges are chamfered.

As seen from the rear in FIG. 1, the members 4, 6 are parallel for part of their length, and they bend toward each other to meet the channel member 8. Reinforced regions 19 are provided at the base of the members 4 and 6 and holes 11 pass through these regions 19 and through the members 4 and 6. Plate members 15 are also each provided with a reinforced region 17 and a hole 13 passes through each reinforced region 17 and the associated plate member 15.

The holes 11 enable the connection of the lifting frame to the lifting arms of a loading machine for moving the frame up and down. The holes 13 enable the end of a piston rod of a hydraulic ram mounted on the loading machine to be connected to the lifting frame, so that the lifting frame can be tilted about the connections through holes 11.

Permanently attached to a conventional loading bucket 9 are two further plate-like members 14 and 16. As seen from the rear in FIG. 1, these two members are parallel near their top, then bend away from one another, then become parallel again with a wider spacing than their upper parallel spacing. Between the upper parallel portions is connected a second mounting member in the form of a bar 18 of circular cross-section which is chosen to be of a size capable of fitting into the semi-circular bottom of the channel member 8. At each end of the bar 18, welded to the associated member 14, 16, is a part cylindrical centralising member 18*a*.

At the base of each member 14, 16 there is provided a hole 20 with a reinforcement boss 20*a* through which a bolt 22, having a tapered nose, is able to pass.

Each of the two bolts 22 is connected to a piston rod 24 of an associated double acting hydraulic ram, a cylinder 26 of which is secured to one of the members 15. Each bolt 22 is guided in a hole 23, reinforced by a boss 25, in one of the members 4, 6. The hydraulic cylinders are operable from a control panel of the loading machine by means of hydraulic supply lines (not shown) connected to the cylinders 26.

The embodiment described enables the loading bucket to be rapidly and conveniently attached to the loading vehicle in a secure and robust manner without the vehicle operator having to dismount.

Figure 3:
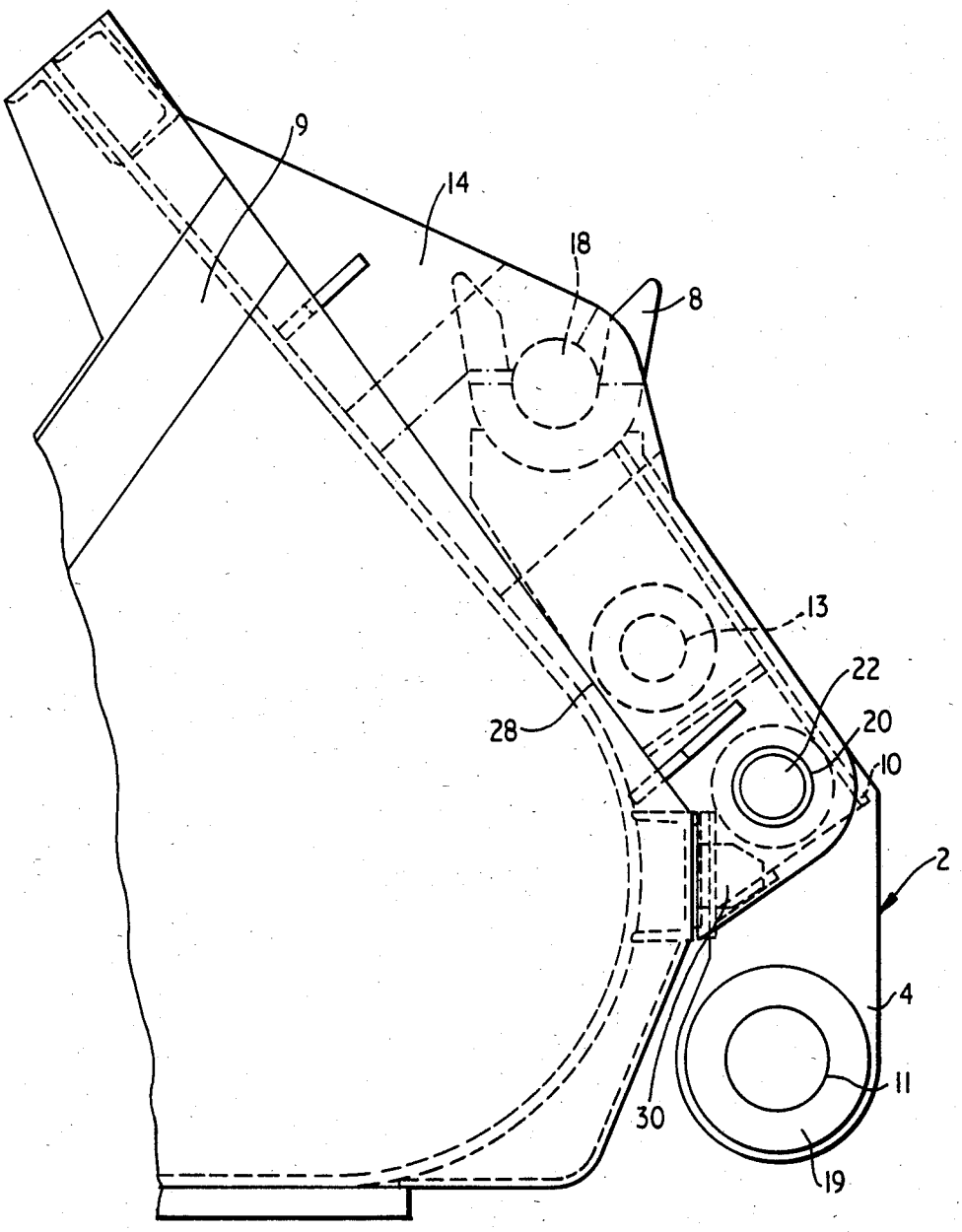
FIG. 3 is a side view of part of the bucket and the frame when coupled together but not in the lifted position.

To attach the bucket the lifting frame 2 is positioned behind the bucket 9 by movement of the loading machine, as well as by appropriate vertical movement of the arms which are attached by holes 19 and by appropriate operation of the hydraulic ram whose piston is connected by means of holes 13 so that the bar 18 is received in the channel member 8, as shown in FIG. 3. As the channel 8 is moved upwardly to engage the bar, it is centralised by the inwardly tapering shape of the members 14 and 16 and by the centralising members 18*a*. Final engagement is made easier by the flared sides and chamfered edges of the channel member 8 which help to guide the bar 18 into the channel. Centralisation of the frame on the bucket is aided by the provision of tapered lugs 30 which engage and guide the lower portions of the frame with respect to the bucket connections.

In this position, part of the members 4, 6 abut the bucket, for example at 28, and furthermore the bolts 22, which are, at this stage, retracted, are aligned with the holes 20. The hydraulic rams 26 are extended by an appropriate action on the part of the operator on the loading machine, whereupon the rams push the bolts 22 into the holes 20. Thus the bucket is securely attached to the lifting frame 2, since separation would require a downward motion of the lifting frame 2 with respect to the bucket, to draw the channel member 8 clear of the bar 18, and such downward relative movement is prevented by the horizontal bolts 22. The majority of the weight of the bucket, and any load carried thereby, is borne by the channel member 8, and any transverse motion is prevented by the abutment of the lifting frame and the bucket at points 28. Thus in normal use the bolts do not bear any heavy load.

Figure 2:
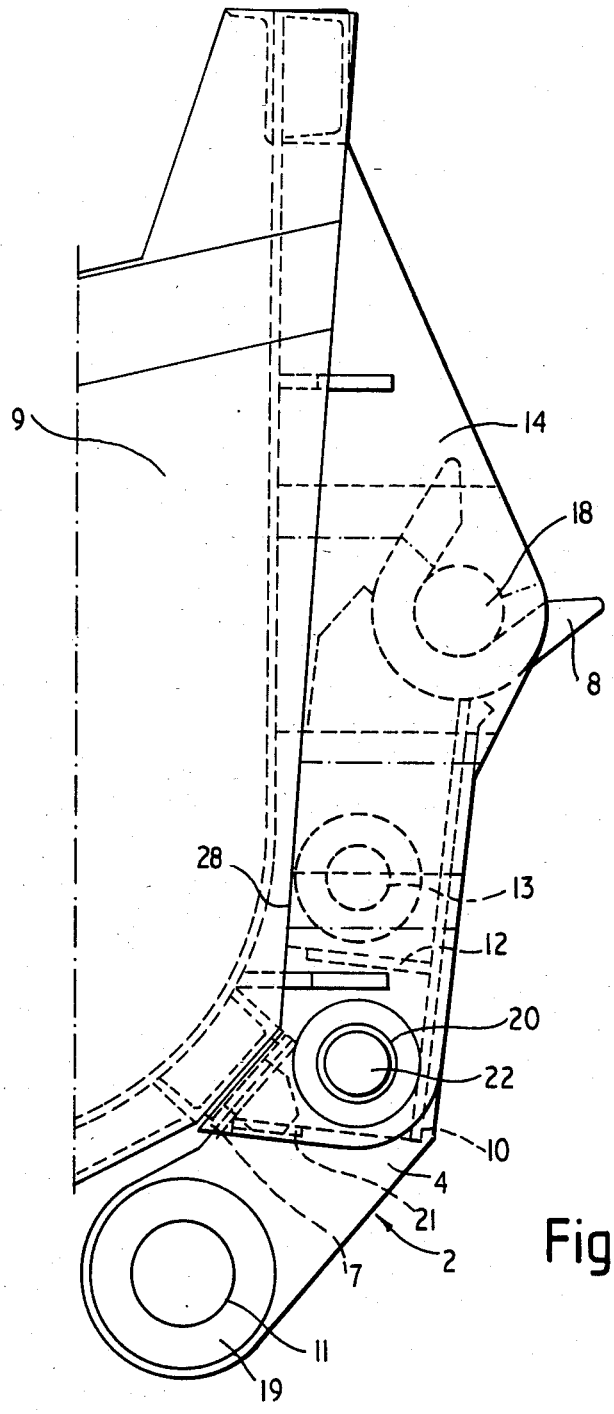
FIG. 2 is a side view of part of the bucket and the frame shown in FIG. 1.

When the lifting frame and the bucket have been connected as described above, the bucket may be raised (as shown in FIGS. 1 and 2) or lowered (as shown in FIG. 3) to be filled and emptied without fear of the bucket becoming detached from the lifting frame.

When it is desired to detach the bucket from the loading frame, for example for replacement or repair, or substitution of another accessory, the reverse operation is performed. Namely the bucket is lowered to the ground as shown in FIG. 3, the hydraulic rams 26 are operated to retract the bolts 22 from the holes 20, and the lifting frame is lowered until the channel 8 is clear of the bar 18.

The invention is not restricted to the details of the foregoing embodiment. For example, as well as being supported at its ends by the two members 14 and 16, the bar may have an additional central support, as shown by chain dot lines 27 in FIGS. 1 and 2.

To accommodate this extra support, the walls of the channel member 8 may be slightly cut-away as shown in chain dot lines 29 in FIG. 1.

From the drawings it will be readily noted that the holes 20 for receiving bolts 22 are mounted substantially closer to the bottom of the accessory 9 than the elongated mounting member or bar 18, which extends generally horizontally across at least the major portion of the back of the accessory 9. Channel 8 extends across at least a major portion of bar 18. The holes 11, the bolts 22 and the channel 8 (or, alternatively, bar 18) each have an axis, with the axes of these members being such that when the accessory is coupled to a vehicle the channel axis is closer to the top of the accessory than the axes of the bolts or the vehicle mounting hole, and the axis of the vehicle mounting hole is closer to the bottom of the accessory than the axes of the bolts 22 and the channel 8. The axes of the bolts 22 and channel 8 define a plane, with the axis of holes 11 being displaced from that plane in a direction away from the vehicle and toward the accessory. With this particular arrangement of the axes of the above-described three elements, a portion of the device attached to the vehicle, and proximate the vehicle mounting hole 11, abuts the bucket or other accessory when the accessory is coupled to the vehicle, with the location of the abutment being below at least a portion of the vehicle so that the accessory is in part supported by the abutment.

FIG. 3, which depicts a bucket 9 and connection device when coupled together, but not in a lifted position, illustrates the arrangement of the parts of a combination which are highly advantageous for ease of connection of the channel 8 with the bar 18. The back of bucket 9 is inclined at an angle, with the top of the back of the bucket being over the bottom of the bucket. The bar 18 is also vertically above the bucket bottom. The opening into channel 8 is wider than the distance between the back of the bucket and the axis of bar 18, so that in operation when the elongated channel is moved toward bar 18, it has a tendency to engage bar 18 even if initially somewhat misaligned. The angled back of the bucket tends to guide the channel 8 upward bar 18, and the greater width of the channel opening tends to guide the bar 18 into the channel opening, even if channel and the bar are not initially in aligned register.

The specific embodiment has been directed specifically to the connection of a detachable bucket to a loading machine. However in principle the invention can be applied to the connection of any item to a vehicle, for example a bulldozer attachment, forklift device, personnel platform, tool or other accessory.

I claim:

1. A releasable connection device for coupling an accessory having a top, a bottom and a back to a vehicle, comprising a first mounting assembly for connection to the vehicle and a second mounting assembly for mounting to the accessory, said second mounting assembly comprising an enlongated mounting member attached to the accessory and extending generally horizontally across at least the major portion of the back thereof, and a first securing means mounted on the accessory closer to the bottom thereof than said elongated mounting member, said first mounting assembly comprising an elongated channel means for receiving and supporting said elongated mounting member and extending across at least a major portion thereof, second securing means for engaging said first securing means for retaining said elongated mounting member in said channel member and for selectively being disengaged from said first securing means to enable the elongated mounting member to be disengaged from the channel member, and vehicle mounting means for pivotably mounting said first mounting assembly to the vehicle, said vehicle mounting means, said second securing means and said channel means each having an axis, the axes being such that when the accessory is coupled to a vehicle the channel means axis is closer to the accessory top than the axes of the second securing means and the vehicle mounting means, and the axis of the vehicle mounting means is closer to the bottom of the accessory then the axes of the second securing means and the channel means, the axes of the second securing means and the channel means defining a plane, the axis of the vehicle mounting means being displaced from said plane in a direction away from said vehicle.

2. Device of claim 1, wherein when said attachment is resting with the bottom thereof on the ground, the back of the accessory is inclined at an angle with the top of the back of the accessory being over the bottom, and the elongated mounting member being vertically over the bottom of the accessory, the elongated channel having an opening into said channel, the elongated mounting member having an axis, the width of said opening being greater than the distance between the elongated mounting member axis and the back of the accessory.

3. Device of claim 1, wherein the elongated mounting member is a bar.

4. Device of claim 3, wherein centering means are located at each end of the bar for centering the channel means on the bar upon engagement of said accessory to said vehicle.

5. Device of claim 4, wherein said centering means comprises a pair of part cylindrical members affixed at each end of said bar.

6. Device of claim 1, wherein the second securing means comprises at least one bolt, said first securing means comprises at least one hole, said bolt being capable of passing into said hole.

7. Device of claim 2, wherein the second securing means comprises at least one bolt, said first securing means comprises at least one projection, said bolt being capable of engaging behind said projection.

8. Device of claim 6, wherein said bolt in use is substantially horizontal.

9. Device as claimed in claim 8, wherein said second securing means comprises two of said bolts, with the bolts moving in opposite directions to engage said first securing means.

10. Device of claim 1, wherein said accessory is a bucket.

11. Device as claimed in claim 2, wherein a portion of the first mounting assembly which is proximate the vehicle mounting means abuts the accessory when the accessory is coupled to the vehicle, with the point of abutment being in a location such that the accessory is in part supported by such abutment.

* * * * *